US010693255B2

(12) United States Patent
Hasui

(10) Patent No.: US 10,693,255 B2
(45) Date of Patent: Jun. 23, 2020

(54) CONNECTOR-EQUIPPED ELECTRICAL WIRES, AND FITTING BODY FOR CONNECTOR-EQUIPPED ELECTRICAL WIRES

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventor: Hiroyuki Hasui, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/325,036

(22) PCT Filed: Aug. 16, 2017

(86) PCT No.: PCT/JP2017/029446
§ 371 (c)(1),
(2) Date: Feb. 12, 2019

(87) PCT Pub. No.: WO2018/043130
PCT Pub. Date: Mar. 8, 2018

(65) Prior Publication Data

US 2019/0356079 A1 Nov. 21, 2019

(30) Foreign Application Priority Data

Aug. 29, 2016 (JP) ..... 2016-166727

(51) Int. Cl.
*H01R 13/62* (2006.01)
*H01R 13/52* (2006.01)

(52) U.S. Cl.
CPC ..... *H01R 13/52* (2013.01)

(58) Field of Classification Search
CPC ..... F21V 23/003; H01R 13/52; H01R 13/533; H01R 13/6592; H04R 1/1016; G01L 19/143; G01D 11/245; A61B 10/0233
(Continued)

(56) References Cited

U.S. PATENT DOCUMENTS 7,494,473 B2 * 2/2009 Eggers ..... A61B 10/0233 600/564
8,656,786 B2 * 2/2014 Jones ..... G01L 19/143 73/717
(Continued)

FOREIGN PATENT DOCUMENTS

JP 51-017780 2/1976
JP 09-306583 11/1997
(Continued)

OTHER PUBLICATIONS

Official Communication issued in International Bureau of WIPO Patent Application No. PCT/JP2017/029446, dated Sep. 12, 2017, along with an English translation thereof.

*Primary Examiner* — Jean F Duverne
(74) *Attorney, Agent, or Firm* — Greenblum & Bernstein, P.L.C.

(57) ABSTRACT

A connector-equipped electrical wire includes a connector housing that includes a cavity that opens on a back side; a terminal-equipped electrical wire that includes an electrical wire and a terminal attached to an end portion of the electrical wire, and that is connected to the connector housing in a state where the terminal is held inside the cavity and also where the electrical wire runs through a back
(Continued)

surface-side opening of the cavity and extends outward of an outer circumference of the connector housing; and a covering member that is attached to the connector housing so as to open on a side where the electrical wire extends outward of the outer circumference of the connector housing and also so as to cover at least the opening of the cavity on the back side of the connector housing.

14 Claims, 4 Drawing Sheets

(58) Field of Classification Search
USPC ..... 439/367
See application file for complete search history.

(56) References Cited

U.S. PATENT DOCUMENTS

| | | | | |
|---|---|---|---|---|
| 8,671,753 | B2 * | 3/2014 | Eckhardt | G01D 11/245 73/431 |
| 9,398,365 | B2 * | 7/2016 | Liu | H04R 1/1016 |
| 9,640,919 | B2 * | 5/2017 | Loveless | H01R 13/6592 |
| 9,882,304 | B2 * | 1/2018 | May | H01R 13/533 |
| 10,222,005 | B2 * | 3/2019 | Norton | F21V 23/003 |

FOREIGN PATENT DOCUMENTS

| | | |
|---|---|---|
| JP | 2005-056631 | 3/2005 |
| JP | 2013-187004 | 9/2013 |

* cited by examiner

CONNECTOR-EQUIPPED ELECTRICAL WIRES, AND FITTING BODY FOR CONNECTOR-EQUIPPED ELECTRICAL WIRES

FIELD OF THE INVENTION

The present invention relates to a technology that inhibits the occurrence of foreign matter inside a connector.

BACKGROUND OF THE INVENTION

Patent Literature 1 discloses a connector-equipped electrical wire provided with an electrical wire, a connector connected to an end portion of the electrical wire, and a sheathing member covering a gap between the connector and the electrical wire. The sheathing member is configured by a member in which an ultraviolet curable adhesive tape, which has a two-layer structure having an adhesive agent and a base body made of a tape-like ultraviolet curable resin, is wrapped over a portion spanning from the connector to the electrical wire with the adhesive agent facing inward, and is then cured.

RELATED ART

Patent Literature

Patent Literature 1: Japanese Patent Laid-open Publication No. 2013-187004

SUMMARY OF THE INVENTION

Problems to be Solved by the Invention

However, in the technology disclosed in Patent Literature 1, the ultraviolet curable adhesive tape must be wrapped over a portion spanning from the connector to the electrical wire, which is cumbersome work. Therefore, an excessive waterproofing sheath structure results in locations other than a location where a high waterproofing performance is required.

However, even in locations other than a location where a high waterproofing performance is required, a foreign body may occur inside the connector, and there is a risk that this may have some sort of effect on electrical performance of the connector.

In view of this, the present invention has as an object to make possible inhibition of the occurrence of foreign matter inside a connector with a simple structure.

Means for Solving the Problems

In order to resolve the above-noted issues, a connector-equipped electrical wire according to a third aspect includes a connector housing that includes a cavity that opens on a back side; a terminal-equipped electrical wire that includes an electrical wire and a terminal attached to an end portion of the electrical wire, and that is connected to the connector housing in a state where the terminal is held inside the cavity and also where the electrical wire is curved so as to run through the back-side opening of the cavity and extend outward of an outer circumference of the connector housing; and a covering member that is attached to the connector housing so as to open on a side where the electrical wire extends outward of the outer circumference of the connector housing and also so as to cover at least the opening of the cavity on the back side of the connector housing.

In the third aspect, the covering member is attached to the connector housing so as to also open on the opposite side from the side where the electrical wire extends outward of the outer circumference of the connector housing.

In the third aspect the electrical wire is drawn in a downward direction in an installation posture of the connector housing.

A fourth aspect is the connector-equipped electrical wire according to the third aspect, in which the covering member is configured by an adhesive tape that is adhered to the connector housing.

A fitted body of a connector-equipped electrical wire according to a fifth aspect includes the connector-equipped electrical wire according to the third or fourth aspects; a mating connector housing having a mating cavity that opens on a back side, and that is fitted together with the connector housing; and a mating terminal-equipped electrical wire having a mating electrical wire and a mating terminal that is attached to an end portion of the mating electrical wire, and that is connected to the mating connector housing in a state where the mating terminal is held inside the mating cavity and also where the mating electrical wire is curved so as to run through a back surface-side opening of the mating cavity and extend outward of an outer circumference of the mating connector housing. The covering member is attached to a fitted body in a state surrounding a circumference of the fitted body, which is configured by the connector housing and the mating connector housing, such that, in a state where the connector housing and the mating connector housing are fitted together, the covering member opens on a side where the mating electrical wire extends outward of the outer circumference of the mating connector housing and also so as to cover at least the opening of the mating cavity on the back side of the mating connector housing.

Effect of the Invention

According to the third aspect, the covering member may simply be attached to the connector housing so as to open on the side where the electrical wire extends outward of the outer circumference of the connector housing and also so as to cover at least the opening of the cavity on the back side of the connector housing, and therefore a simple structure can be achieved. In addition, air flow is less likely to blow into the cavity through the opening of the cavity, and therefore the occurrence of foreign matter inside the connector can be inhibited.

According to the third aspect, the covering member is attached to the connector housing so as to also open on the opposite side from the side where the electrical wire extends outward of the outer circumference of the connector housing, and therefore the covering member can be readily attached to the connector housing.

According to the third aspect, a liquid traveling along the electrical wire is less likely to enter inside the cavity.

According to the fourth aspect, a general-purpose adhesive tape can be used.

According to the fifth aspect, the covering member covers the opening of the cavity and the opening of the mating cavity in a state where the covering member surrounds the circumference of the fitted body of the connector housing and the mating connector housing, and therefore the occurrence of foreign matter inside each of the fitted together connector housing and mating connector housing can be inhibited with a simple structure.

MODE FOR CARRYING OUT THE INVENTION

Figure 1:
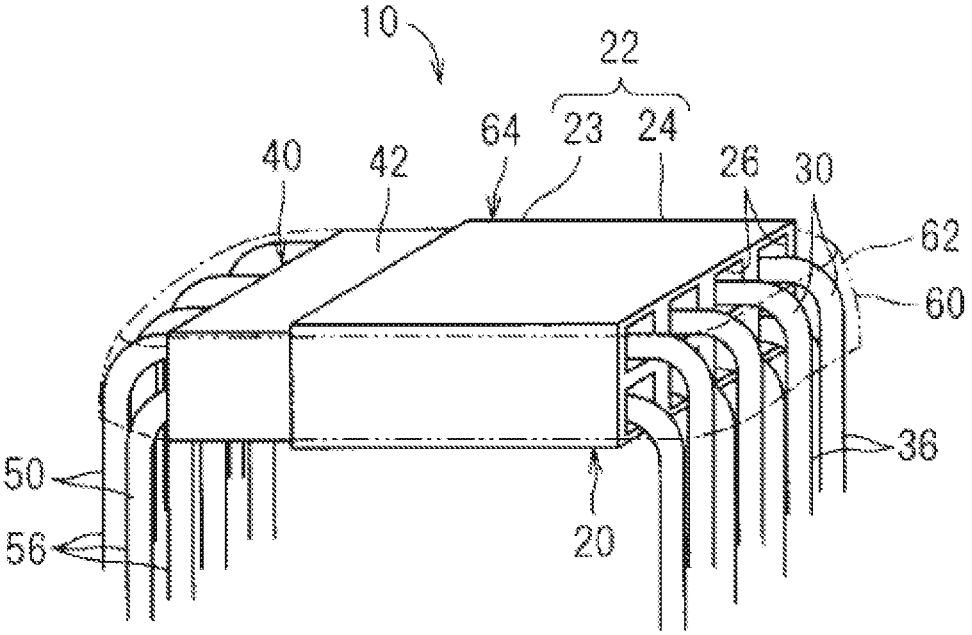
FIG. 1 is a schematic perspective view illustrating a fitted body of connector-equipped electrical wires according to an embodiment.
Figure 2:
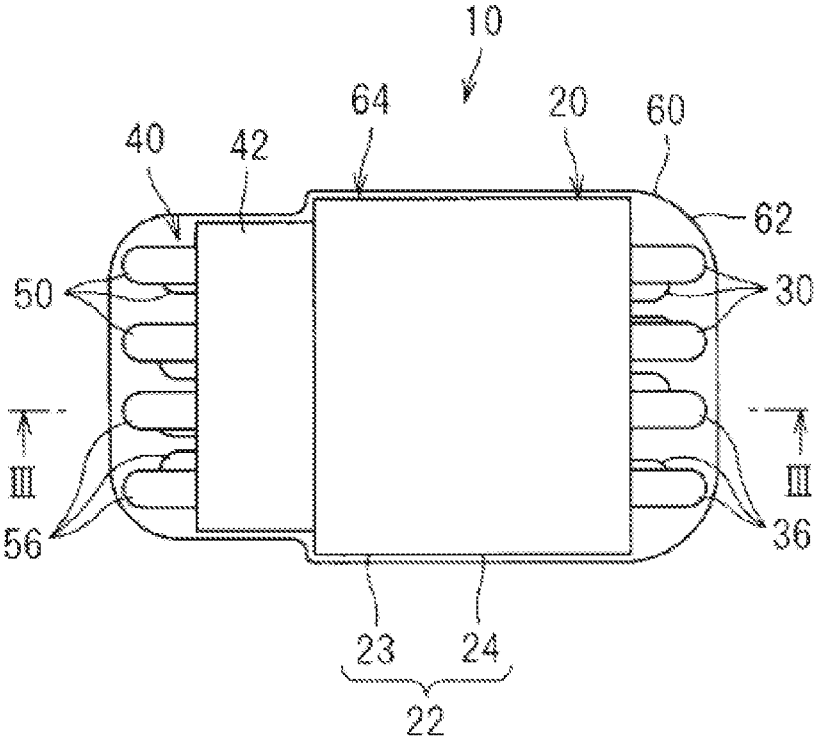
FIG. 2 is a schematic plan view illustrating the fitted body.
Figure 3:
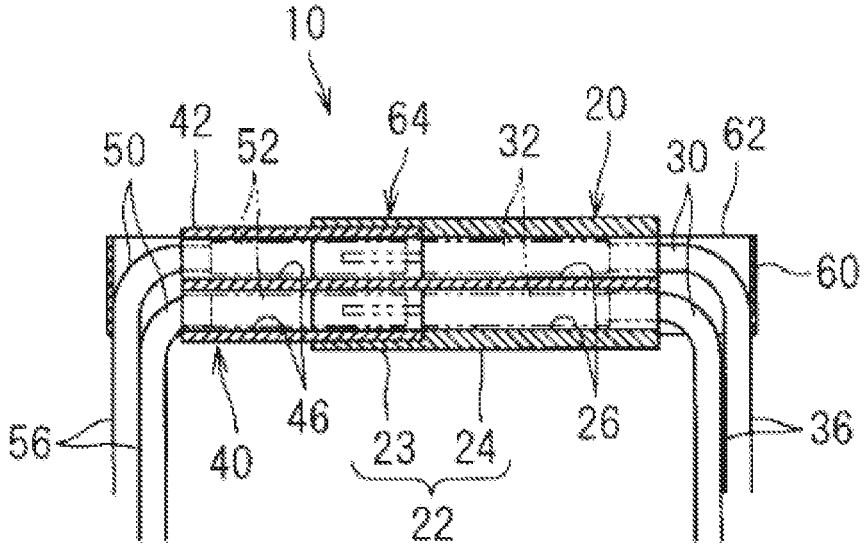
FIG. 3 is a schematic cross-sectional view along a line III-III in FIG. 2.

A fitted body of connector-equipped electrical wires according to an embodiment and that includes connector-equipped electrical wires is described below. FIG. 1 is a schematic perspective view illustrating a fitted body 10 of connector-equipped electrical wires 20 and 40. FIG. 2 is a schematic plan view illustrating the fitted body 10. FIG. 3 is a schematic cross-sectional view along a line III-III in FIG. 2.

The fitted body 10 of the connector-equipped electrical wires 20 and 40 is provided with first connector-equipped electrical wires 20, second connector-equipped electrical wires 40, and a covering member 60. This fitted body 10 may be used as a wiring material in a vehicle or the like, for example. The fitted body 10 of the connector-equipped electrical wires 20 and 40 is preferably used in a manner arranged in a location where there is little risk of regular water exposure, such as inside a vehicle cabin.

The first connector-equipped electrical wires 20 include a connector housing 22 and terminal-equipped electrical wires 30.

The connector housing 22 is formed with an insulating material such as a resin. A cavity 26 that opens on a back side is formed in the connector housing 22.

More specifically, the connector housing 22 includes a base end portion 24 and a cylindrical leading end portion 23. The base end portion 24 is formed in a rectangular parallelepiped shape, and more specifically is formed in a flat rectangular parallelepiped shape. The cavity 26 is formed within the base end portion 24, running through the base end portion 24 from the leading end side toward the back side. In this example, the cavity 26 is formed in a rectangular hole shape, and a back-side opening has a rectangular shape. The leading end portion 23 is formed in a cylindrical (in this example, squared cylinder) shape that projects from a leading end portion of the base end portion 24. A leading end-side opening of the cavity 26 opens within the leading end portion 23, which has a cylindrical shape. A mating connector housing 42 described below is fitted together with the leading end portion 23. In this example, a side of the connector housing 22 that is fitted together with the mating connector housing 42 is referred to as the leading end side and the opposite side of the connector housing 22 is referred to as the back side.

A plurality of the cavities 26 are formed in the base end portion 24. The plurality of cavities 26 are arranged at different positions in each of a width direction and height direction of the connector housing 22, and are formed so as to run through in a front/back direction. In this example, the plurality of cavities 26 are formed so as to be regularly aligned in two vertical columns and four lateral rows. The number of cavities 26 in the width direction and in the height direction is determined as desired in accordance with the number of terminals required by the connector housing, or the like. A projection for terminal engagement and fixation (sometimes referred to as a lance) is formed within the cavity 26, and when a terminal 32 is inserted from the back-side opening of the cavity 26, the terminal 32 is held inside the cavity 26 in a locked manner.

The terminal-equipped electrical wire 30 includes the terminal 32 and an electrical wire 36, and is connected to the connector housing 22 described above.

The electrical wire 36 is configured such that a sheath portion is formed by extrusion coating, for example, an insulating resin onto an outer circumference of an electrically conductive core wire. The core wire is formed of aluminum, an aluminum alloy, copper, a copper alloy, or the like as a raw material. In a state where the electrical wire 36 is arranged in an intended placement location of a vehicle or the like, the electrical wire 36 is used as a component that electrically connects various electrical devices installed in the vehicle or the like.

At an end portion of the electrical wire 36, the sheath portion is stripped off and the core wire is exposed. The terminal 32 is connected to the exposed core wire by crimping or the like.

The terminal 32 is a member that is formed by pressing a metal plate or the like. Aluminum, an aluminum alloy, copper, a copper alloy, or the like can be used as the metal plate. When the core wire of the electrical wire 36 and the terminal 32 are formed with different metals, galvanic corrosion is likely to occur at the site where the two are connected. Galvanic corrosion is more likely to occur when different metals are exposed to an electrolytic aqueous solution. Therefore, inhibiting the adhesion of foreign matter to the terminal 32 within the cavity 26, to the core wire of the electrical wire 36, and the like is preferred.

The terminal 32 includes an electrical wire connection portion and a connection portion. The electrical wire connection portion is a portion that is attached to an end portion of the electrical wire 36, and includes a sheath crimping portion that is crimped to the sheath of the electrical wire 36 and a core wire crimping portion that is crimped to the core wire. The connection portion is a portion that is electrically connected to a mating terminal. The connection portion may have a cylindrical female terminal shape, or may have a tab- or pin-like male terminal shape. Here, an example is described where the connection portion has a male terminal shape.

In a state where the terminal 32 is attached to the end portion of the electrical wire 36, the terminal 32 is inserted into the cavity 26 from the back-side opening of the cavity 26 and is retained within the cavity 26. In this state, the connection portion projects from the base end portion 24 into the leading end portion 23.

In this state, the electrical wire 36 is curved so as to run through the back-side opening of the cavity 26 and extend outside the connector housing 22. At the location where the electrical wire 36 extends from the back-side opening of the cavity 26, the electrical wire 36 is curved so as to form an arc having a central angle of 90°, and extends outward of the outer circumference of the connector housing 22. "Outward of the outer circumference of the connector housing 22" refers to a direction that is orthogonal to the direction in which the connector housing 22 is fitted together with the mating connector housing 42. In this example, the electrical wire 36 is drawn out in a direction orthogonal to a flat direction of the connector housing 22. In the present embodiment, a plurality of the electrical wires 36 extending from the plurality of cavities 26 are drawn out in the same direction. The plurality of electrical wires 36 are preferably drawn out in the same direction, but this is not strictly necessary. For example, a portion of the plurality of electrical wires may also be drawn out in one direction oriented outward of the outer circumference of the connector housing and the remainder may be drawn out in the opposite direction.

A component having the terminals 32 installed in the connector housing 22 is a connector.

The second connector-equipped electrical wires 40 include the mating connector housing 42 and mating terminal-equipped electrical wires 50.

The mating connector housing 42 is formed with an insulating material such as a resin. A mating cavity 46 that opens on the back side is formed in the mating connector housing 42.

The mating connector housing 42 is configured to be capable of fitting together with the connector housing 22. More specifically, the mating connector housing 42 is formed in a rectangular parallelepiped shape, and in this example is formed in a flat rectangular parallelepiped shape. A leading end portion of the mating connector housing 42 is configured to be capable of fitting inside the leading end portion 23.

The mating cavity 46 is formed within the mating connector housing 42, running through the mating connector housing 42 from the leading end side toward the back side. In this example, the mating cavity 46 is formed in substantially a squared tube shape in a front view, and a back-side opening has a rectangular shape. In this example, a side of the mating connector housing 42 that is fitted together with the connector housing 22 is referred to as the leading end side and the opposite side of the mating connector housing 42 is referred to as the back side.

A plurality of the mating cavities 46 are formed on the mating connector housing 42. The plurality of mating cavities 46 are formed at different positions in each of a width direction and height direction of the mating connector housing 42. In this example, the plurality of mating cavities 46 are formed so as to be regularly aligned in two vertical columns and four lateral rows in order to match the plurality of cavities 26 described above. A projection for terminal engagement (sometimes referred to as a lance) is formed within the mating cavity 46, and when a mating terminal 52 is inserted from the back-side opening of the mating cavity 46, the mating terminal 52 is held inside the mating cavity 46 in a locked manner.

The mating terminal-equipped electrical wire 50 includes the mating terminal 52 and a mating electrical wire 56, and is connected to the mating connector housing 42 described above.

The mating electrical wire 56 is a component similar to the electrical wire 36.

The mating terminal 52 is a component similar to the terminal 32 described above. However, the mating terminal 52 is configured so as to be capable of connecting to the terminal 32, and therefore the connection portion of the mating terminal 52 is formed in a cylindrical female terminal shape.

In a state where the mating terminal 52 is attached to the end portion of the mating electrical wire 56, the mating terminal 52 is inserted into the mating cavity 46 from the back-side opening of the mating cavity 46 and is retained within the mating cavity 46. In this state, the connection portion is installed within the mating cavity 46.

The mating electrical wire 56 is curved so as to run through the back-side opening of the mating cavity 46 and extend outward of the outer circumference of the mating connector housing 42. At the location where the mating electrical wire 56 extends from the back-side opening of the mating cavity 46, the mating electrical wire 56 is curved so as to form an arc having a central angle of 90°, and extends outward of the outer circumference of the mating connector housing 42. As noted above, "outward of the outer circumference of the mating connector housing 42" refers to a direction that is orthogonal to the direction in which the mating connector housing 42 is fitted together with the connector housing 22. In this example, the mating electrical wire 56 is drawn out in the same direction as the electrical wire 36, in a direction orthogonal to a flat direction of the mating connector housing 42. As noted above, the plurality of mating electrical wires 56 are drawn out in the same direction.

In a state where the connector housing 22 and the mating connector housing 42 are connector-fitted together, the connection portion of the terminal 32 that projects from the base end portion 24 of the connector housing 22 is inserted into and connected to the connection portion of the mating terminal 52 installed within the leading end portion 23, and accordingly the terminal 32 and the mating terminal 52 are kept in a connected state.

When expressed via its relationship with the first connector-equipped electrical wires 20, the covering member 60 is a member that is attached to the connector housing 22 so as to cover the openings of the cavities 26 on the back side of the connector housing 22 in a state where the covering member 60 is open on a side where the electrical wires 36 extend outward of the outer circumference of the connector housing 22 (downward of the back side of the connector housing 22 in FIG. 3). Furthermore, when expressed via its relationship with the second connector-equipped electrical wires 40, the covering member 60 is a member that is open on a side where the mating electrical wires 56 extend outward of the outer circumference of the mating connector housing 42 (downward of the back side of the connector housing 42 in FIG. 3), and is also attached to the mating connector housing 42 so as to cover the openings of the mating cavities 46 on the back side of the mating connector housing 42.

In this example, the covering member 60 is formed by an adhesive tape 62 having an adhesive layer formed on one principal surface of a band-shaped substrate material made of a resin such as polyvinyl chloride. The adhesive tape 62 is wrapped so as to surround a circumference of a fitted body 64, which is configured by the connector housing 22 and the mating connector housing 42. More specifically, the adhesive tape 62 is wrapped around the fitted body 64 on a back portion of the connector housing 22, a back portion of the mating connector housing 42, and two opposing side surfaces of the fitted body 64, and adheres to these portions, thereby forming the covering member 60. The adhesive tape 62 may be wrapped once around the fitted body 64, or may be wrapped around a plurality of times. In addition, when the adhesive tape 62 is wrapped around the fitted body 64 a plurality of times, this may also be done by offsetting the adhesive tape 62 on each pass. By doing this, a region having a desired width that is equal to or greater than the width of the adhesive tape 62 can be covered. The adhesive tape 62 adheres to both side surfaces of the connector housing 22 or the mating connector housing 42 on both side surface sides of the fitted body 64. In addition, at the back portion of the connector housing 22, the adhesive tape 62 adheres to a curved portion of the electrical wire 36 from the exterior, the electrical wire 36 being drawn out and curving from the noted back portion, and the adhesive tape 62 plays a role of maintaining a state where the electrical wire 36 is drawn out in the above-noted direction. Also, at the back portion of the mating connector housing 42, the adhesive tape 62 adheres to a curved portion of the mating electrical wire 56 from the exterior, the mating electrical wire 56 being drawn out and curving from the noted back portion, and the adhesive tape 62 plays a role of maintaining a state where the mating electrical wire 56 is drawn out in the above-noted direction. In either case, the covering member 60 is attached to the connector housing 22, and is also attached to the mating connector housing 42.

Figure 4:
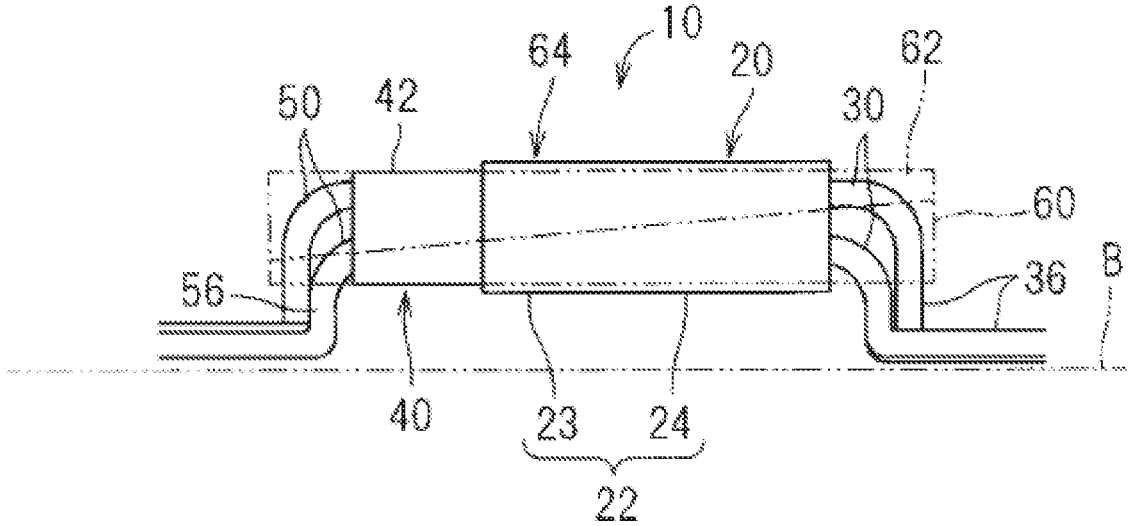
FIG. 4 is an explanatory diagram illustrating a relationship between an installation posture of the connector-equipped electrical wires and an extension direction of the wires.

As illustrated in FIG. 4, imagining an installation posture where the fitted body 10 of the connector-equipped electrical wires 20 and 40 is arranged along a body B or the like of the vehicle or the like, the electrical wires 36 and 56 are preferably drawn in a downward direction in the direction of gravity. This is because, by doing so, water is less likely to travel along the electrical wires 36 and 56 to infiltrate the interior of the connector housing 22 and the mating connector housing 42. The electrical wires 36 and 56 may also be drawn out obliquely in a downward direction.

In a state where the covering member 60 covers the connector housing 22, an opening is formed between the covering member 60 and the connector housing 22, on the side where the electrical wires 36 are drawn out (in this example, a first side perpendicular to the flat direction of the connector housing 22). In addition, here, an opening is also formed between the covering member 60 and the connector housing 22 on the opposite side from the side where the electrical wires 36 extend (a second side perpendicular to the flat direction of the connector housing 22).

Figure 5:
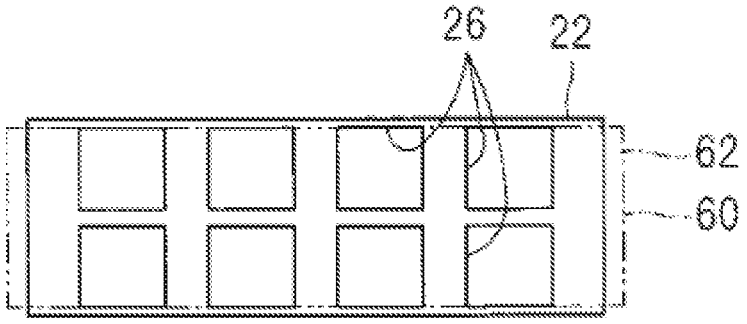
FIG. 5 is an explanatory diagram illustrating a relationship between a back-side opening of a cavity and a covering member.

Also, as illustrated in FIG. 5, when viewing the connector housing 22 from the back side, the covering member 60 covers the back-side openings of the cavities 26. Preferably, when viewing the connector housing 22 from the back side, a region where the openings of the plurality of cavities 26 are provided is provided inside a region where the covering member 60 is provided.

Also, similarly, in a state where the covering member 60 covers the mating connector housing 42, an opening is formed between the covering member 60 and the mating connector housing 42, on the side where the mating electrical wires 56 are drawn out (in this example, a first side perpendicular to the flat direction of the mating connector housing 42). In addition, here, an opening is also formed between the covering member 60 and the mating connector housing 42 on the opposite side from the side where the mating electrical wires 56 extend (a second side perpendicular to the flat direction of the mating connector housing 42).

Also, when viewing the mating connector housing 42 from the back side, the covering member 60 covers the back-side openings of the mating cavities 46. Preferably, when viewing the mating connector housing 42 from the back side, a region where the openings of the plurality of mating connector housings 42 are provided is provided inside a region where the covering member 60 is provided.

Figure 6:
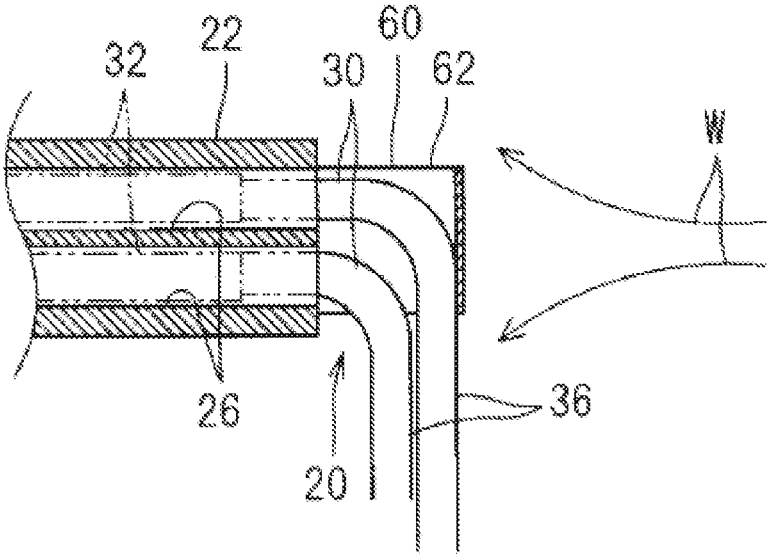
FIG. 6 is an explanatory diagram illustrating the nature of air flow toward the cavity.

According to the connector-equipped electrical wires 20 and 40 and the fitted body 10 of the same that are configured in this way, the covering member 60 covers at least the openings of the cavities 26 and 46 on the back side of the connector housings 22 and 42. Therefore, as illustrated in FIG. 6, even when an air flow W directed into the cavities 26 and 46 blows from the back side of the connector housings 22 and 42, the air flow W is blocked by the covering member 60 and is unlikely to blow directly into the cavities 26 and 46. Therefore, foreign matter caused by foreign matter contained in the air is less likely to occur inside the cavities 26 and 46, and particularly on the surfaces of the terminals 32 and 52. Accordingly, the occurrence of an electrolytic aqueous solution inside the cavities 26 and 46 is inhibited and corrosion or the like of the terminals 32 and 52 is effectively inhibited.

Figure 7:
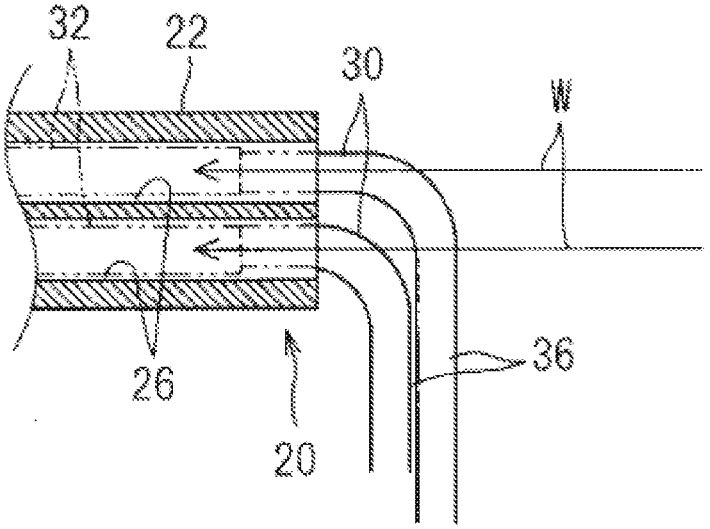
FIG. 7 is an explanatory diagram illustrating the nature of air flow toward the cavity in a comparative example.

When no covering member 60 is provided, as in the comparative example illustrated in FIG. 7, the air flow W blows directly into the cavities 26 of the connector housing 22. Therefore, there is a risk that foreign matter caused by foreign matter contained in the air may occur inside the cavities 26, and particularly on the surface of the terminals 32.

In addition, an opening is formed between the covering member 60 and the connector housings 22 and 42 on the side where the electrical wires 36 and 56 are drawn out. Therefore, the covering member 60 should be attached to the connector housings 22 and 42 to an extent that allows an opening to be provided in such a location. In this example, the adhesive tape 62 is simply wrapped around the fitted body of the connector housings 22 and 42 one or more times. Therefore, a simple structure can be achieved as compared to a configuration where adhesive tape is wrapped in a spiral from the connector to the electrical wire as in the prior art.

Moreover, the covering member 60 is attached to the connector housings 22 and 42 so as to open even on the opposite side from the side where the electrical wires 36 and 56 extend. Therefore, in a state where openings are provided on both sides in this way, the covering member 60 can be attached to the connector housings 22 and 42 more readily.

In other words, although the present configuration does not require water proofing as such, when there is a desire to easily inhibit deterioration due to foreign matter that occurs inside the cavities 26 and 46 (for example, corrosion of the terminal 32 caused by foreign matter, or the like), the present configuration can be said to be an effective configuration.

In addition, even when water occurs inside the cavities 26 and 46, the water can easily exit to the exterior through the openings. In other words, with the openings, a degree of water drainage and air permeability can be ensured.

In addition, when the covering member 60 or the like is to be adjusted, even when the connector housings 22 and 42 are to be temporarily unfitted, so long as a circumference of the covering member 60 is cut, the covering member 60 can be removed. Furthermore, when the adhesive tape 62 is once again wrapped around the circumference of the fitted body of the connector housings 22 and 42, the covering member 60 can be provided once again.

Also, in a state where the connector housings 22 and 42 are attached to the vehicle or the like, the electrical wires 36 and 56 are oriented downward. Therefore, a liquid traveling along the electrical wires 36 and 56 is less likely to enter inside the cavities 26 and 46.

Moreover, the covering member 60 is configured by the adhesive tape 62, and therefore the covering member 60 can be configured by general-purpose adhesive tape 62. In addition, even when the size or the like of the connector housings 22 and 42 changes, the adhesive tape 62 can simply be wrapped around the fitted body of the connector housing 22 and 42 in accordance with that size, and therefore a general-purpose configuration can be achieved that can be applied to connector housings 22 and 42 having various shapes and sizes.

Also, in the present embodiment, the covering member 60 surrounds the circumference of the fitted body of the connector housings 22 and 42, and therefore the occurrence of foreign matter inside the cavities 26 and 46 in the two connector housings 22 and 42, respectively, can be inhibited with a simple configuration.

In addition, the covering member 60 also plays a role of maintaining a state where the connector housings 22 and 42 are fitted together.

Modifications

Figure 8:
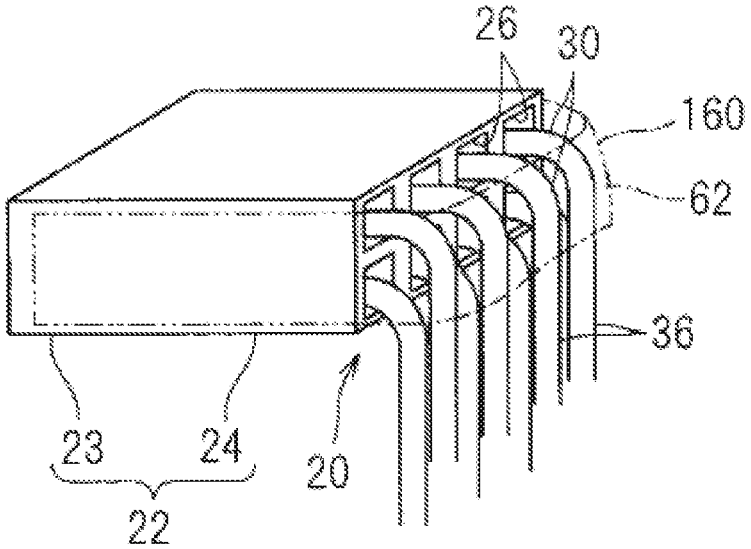
FIG. 8 is a schematic perspective view illustrating terminal-equipped electrical wires according to a modification.

In the embodiment above, an example is described that provides the shared covering member 60 to the fitted body of the connector housings 22 and 42. However, a covering member 160 may also be provided to the connector housing 22 alone, as in the connector-equipped electrical wire 20 illustrated in FIG. 8. In this example, the covering member 160 is configured by the adhesive tape 62, both end portions of the adhesive tape 62 are adhered to both surfaces of the connector housing 22, and an extension direction middle portion of the adhesive tape 62 covers, from the exterior, a curving location of the plurality of electrical wires 36 from the back side of the connector housing 22. Therefore, similar to the embodiment described above, the infiltration of air flow into the cavities 26 can be inhibited, and also the occurrence of foreign matter on the interior can be inhibited with a simple configuration.

Furthermore, the covering member 60 does not need to be configured by the adhesive tape 62. For example, a ring-shaped elastic member having a width sufficient to cover the back-side openings of the cavities 26 and 46 of the connector housings 22 and 42 (for example, a broad rubber band or the like) may be configured to wrap around the circumference of the fitted body so as to surround the circumference of the fitted body of the connector housings 22 and 42. In the case of a ring-shaped elastic member such as this, the elastic member is capable of extending and contracting, and therefore can be mounted to connector housings 22 and 42 having a certain size and shape, and can impart versatility.

Also, the covering member 60 may be a die-molded component made of resin that is specially designed in accordance with the size and shape of the connector housings 22 and 42.

The configurations described in the above embodiment and modifications can be combined as appropriate so long as they do not contradict each other.

In the above, the present invention is described in detail. However, the above description is, in all aspects, for exemplary purposes and the present invention is not limited thereto. Numerous modifications not given as examples are understood to be conceivable without departing from the scope of the present invention.

DESCRIPTION OF REFERENCE NUMERALS

10 Fitted body of connector-equipped electrical wires
20 First connector-equipped electrical wire
22 Connector housing
26 Cavity
30 Terminal-equipped electrical wire
32 Terminal
36 Electrical wire
40 Second connector-equipped electrical wire
42 Mating connector housing
46 Mating cavity
50 Mating terminal-equipped electrical wire
52 Mating terminal
56 Mating electrical wire
60, 160 Covering member
62 Adhesive tape
64 Fitted body of connector housing

What is claimed is:

1. A connector-equipped electrical wire comprising:

a connector housing that includes a cavity that opens on a back side;

a terminal-equipped electrical wire that includes an electrical wire and a terminal attached to an end of the electrical wire, and that is connected to the connector housing when the terminal is held inside the cavity and the electrical wire is curved so as to run through a back surface-side opening of the cavity and extend outward of an outer circumference of the connector housing; and a cover that is attached to the connector housing so as to open on a side where the electrical wire extends outward of the outer circumference of the connector housing, to open on an opposite side from the side where the electrical wire extends outward of the outer circumference of the connector housing, and to cover at least the opening of the cavity on the back side of the connector housing, wherein the electrical wire is drawn in a downward direction in an installation posture of the connector housing, and a first opening that is uncovered by the cover is formed with a periphery of the first opening defined by the back side of the connector housing and the cover, and the first opening opens toward a direction opposite to the downward direction in which the electrical wire is drawn in the installation posture.

2. The connector-equipped electrical wire according to claim 1, wherein the cover is an adhesive tape that adheres to the connector housing.

3. A fitted body of a connector-equipped electrical wire comprising:

the connector-equipped electrical wire according to claim 1;

a mating connector housing having a mating cavity that opens on a back side, and that is fitted together with the connector housing; and a mating terminal-equipped electrical wire having a mating electrical wire and a mating terminal that is attached to an end of the mating electrical wire, and that is connected to the mating connector housing when the mating terminal is held inside the mating cavity and the mating electrical wire is curved so as to run through a back surface-side opening of the mating cavity and extend outward of an outer circumference of the mating connector housing, wherein the cover is attached to a fitted body including the connector housing and the mating connector housing, to surround a circumference of the fitted body, such that, when the connector housing and the mating connector housing are fitted together, the cover opens on a side where the mating electrical wire extends outward of the outer circumference of the mating connector housing and covers at least the opening of the mating cavity on the back side of the mating connector housing.

4. The connector-equipped electrical wire according to claim 1, wherein a second opening that is uncovered by the cover is formed with a periphery of the second opening defined by the back side of the connector housing and the cover, and the second opening opens toward the downward direction in which the electrical wire is drawn in the installation posture.

5. The connector-equipped electrical wire according to claim 1, wherein in a plan view of the back side of the connector housing, the cover covers an entire surface area of every opening in the back side of the connector housing.

6. The connector-equipped electrical wire according to claim 1, wherein the cover is wrapped around the connector housing a plurality of times.

7. The connector-equipped electrical wire according to claim 1, wherein the cover abuts opposing side surfaces of the connector housing, the opposing side surfaces being connected to top, bottom, and back-side surfaces of the connector housing.

8. The connector-equipped electrical wire according to claim 1, wherein the cover abuts the electrical wire.

9. The connector-equipped electrical wire according to claim 1, wherein the cover abuts the electrical wire at a bend section of the electrical wire where the electrical wire is bent from a direction along an insertion direction of the electrical wire into the connector housing and the downward direction in which the electrical wire is drawn in the installation posture.

10. The connector-equipped electrical wire according to claim 9, wherein the bend section of the electrical wire forms a 90° curved elbow.

11. The connector-equipped electrical wire according to claim 1, wherein a top side of the connector housing is exposed so as to be uncovered by the cover.

12. The connector-equipped electrical wire according to claim 1, wherein the cover is disposed so as to be entirely between top and bottom surfaces of the connector housing.

13. The connector-equipped electrical wire according to claim 1, wherein the cover is a ring-shaped elastic structure.

14. The connector-equipped electrical wire according to claim 1, wherein the terminal and the electrical wire are formed of different metals, and the cover is to inhibit entrance of an electrolytic aqueous solution inside of the cavity and galvanic corrosion at a site where the terminal and the electrical wire are connected.

* * * * *